US012179962B2

(12) United States Patent
Buzzi et al.

(10) Patent No.: US 12,179,962 B2
(45) Date of Patent: Dec. 31, 2024

(54) CLOSURE FOR A STRAW OF THIN-WALLED FLEXIBLE PACKAGING

(71) Applicant: GUALA PACK S.P.A., Castellazzo Bormida (IT)

(72) Inventors: Alberto Buzzi, Castellazzo Bormida (IT); Riccardo Zammori, Castellazzo Bormida (IT)

(73) Assignee: Guala Pack S.P.A., Castellazzo Bormida (IT)

( * ) Notice: Subject to any disclaimer, the term of this patent is extended or adjusted under 35 U.S.C. 154(b) by 0 days.

(21) Appl. No.: 18/256,709

(22) PCT Filed: Dec. 3, 2021

(86) PCT No.: PCT/IB2021/061276
§ 371 (c)(1),
(2) Date: Jun. 9, 2023

(87) PCT Pub. No.: WO2022/123407
PCT Pub. Date: Jun. 16, 2022

(65) Prior Publication Data

US 2024/0043180 A1 Feb. 8, 2024

(30) Foreign Application Priority Data

Dec. 9, 2020 (IT) ..... 102020000030206

(51) Int. Cl.
*B65D 41/34* (2006.01)
*B65D 75/58* (2006.01)

(52) U.S. Cl.
CPC ..... *B65D 41/3495* (2013.01); *B65D 75/5883* (2013.01); *B65D 2401/30* (2020.05)

(58) Field of Classification Search
CPC ..... B65D 41/3495; B65D 75/5883; B65D 2401/30
(Continued)

(56) References Cited

U.S. PATENT DOCUMENTS 8,443,999 B1 * 5/2013 Reinders ..... B65D 41/3409 215/253
2004/0200797 A1 10/2004 Hicks et al.
(Continued)

FOREIGN PATENT DOCUMENTS

IT 201800009967 A1 5/2020
IT 102020000021127 A1 3/2022
(Continued)

OTHER PUBLICATIONS

International Search Report for International Patent Application No. PCT/IB2021/061276, mailed May 25, 2022, 20 pages.

*Primary Examiner* — J. Gregory Pickett
*Assistant Examiner* — Niki M Eloshway
(74) *Attorney, Agent, or Firm* — Armstrong Teasdale LLP

(57) ABSTRACT

A closure for a spout of a thin-walled flexible package is provided. The closure has a cap having a cap wall having a cap axis extending between a cap lower end and a cap upper end, a tamper-evident seal, and a grip surface having an undulated grip surface edge having a succession of low sections and high sections, such that bulges and windows are formed on the grip surface. The windows are sufficiently wide circumferentially to contain the cap and the tamper-evident seal in width. The low section of the undulated grip surface edge is tangent inferiorly to an imaginary plane orthogonal to the cap axis, which axially delimits inferiorly at least one of the bulges. The imaginary plane is arranged axially below the cap lower end.

16 Claims, 7 Drawing Sheets

(58) Field of Classification Search
USPC ..... 220/375
See application file for complete search history.

(56) References Cited

U.S. PATENT DOCUMENTS

| | | | | |
|---|---|---|---|---|
| 2008/0197135 | A1 | 8/2008 | Berman | |
| 2015/0139533 | A1* | 5/2015 | Wu | H04N 13/122 382/154 |
| 2020/0361664 | A1* | 11/2020 | Ekkert | B65D 41/04 |

FOREIGN PATENT DOCUMENTS

| | | | | |
|---|---|---|---|---|
| WO | WO-2014013361 | A1 * | 1/2014 | B65D 41/0485 |
| WO | WO-2017135824 | A1 * | 8/2017 | B65D 41/3428 |
| WO | WO-2020089721 | A1 * | 5/2020 | B65D 47/143 |
| WO | 2020161633 | A1 | 8/2020 | |
| WO | 2020165695 | A1 | 8/2020 | |
| WO | WO-2020240294 | A1 * | 12/2020 | B65D 41/3447 |

* cited by examiner

4

CLOSURE FOR A STRAW OF THIN-WALLED FLEXIBLE PACKAGING

CROSS-REFERENCE TO RELATED APPLICATIONS

This application is a National Stage Application of International Patent Application No. PCT/IB2021/061276, having an International Filing Date of Dec. 3, 2021, which claims priority to Italian Application No. 102020000030206, filed Dec. 9, 2020, the entire contents of each of which are hereby incorporated by reference herein.

FIELD OF THE INVENTION

This invention is in the field of thin-walled flexible packaging, customarily referred to as "pouches," and particularly in the field of pouches fitted with a spout referred to as "spouted pouches."

BACKGROUND OF THE INVENTION

These packages have become very popular and are currently mainly used to contain beverages such as fruit juices and purees, yogurt, energy drinks, supplements and the like; several hundred million pieces are sold each year.

Among the most appreciated features are the versatility and practicality of use, due to the possibility of unscrewing the closure with ease and drinking from the spout. Proper use requires for the closure to be screwed back onto the spout before disposing of the packaging.

However, manufacturers, also driven by new regulations and opinion movements, are looking for technical solutions that allow the closure to remain attached to the spout even after being unscrewed, so that after the use of the packaging, said closure is not dispersed in the environment. For example, the Applicant is the holder of Italian patent application No. 102020000021127.

However, it is necessary for the new solutions to maintain those features of ease of use that have so far distinguished these closures, and in particular the ease of unscrewing the closure from the cap.

SUMMARY OF THE INVENTION

The object of this invention is to satisfy these requirements by constructing a closure that, after disengagement with the spout, remains fastened to said spout and easily graspable by a user and is convenient to use.

This object is achieved by a closure as described and claimed herein. Advantageous embodiments of the present invention are also described.

BRIEF DESCRIPTION OF THE FIGURES

The features and advantages of the closure according to this invention will become apparent from the following description, given by way of non-limiting example according to the figures in the accompanying drawings, wherein.

DETAILED DESCRIPTION

Figure 1C:
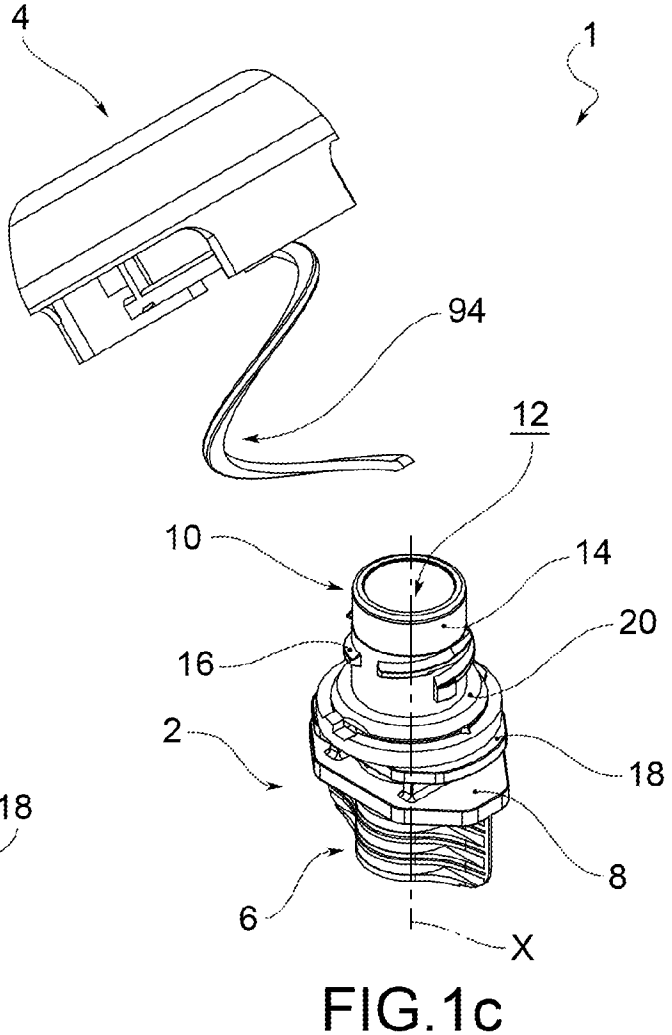
FIG. 1*c* shows a closure assembly in a broken configuration.
Figure 1B:
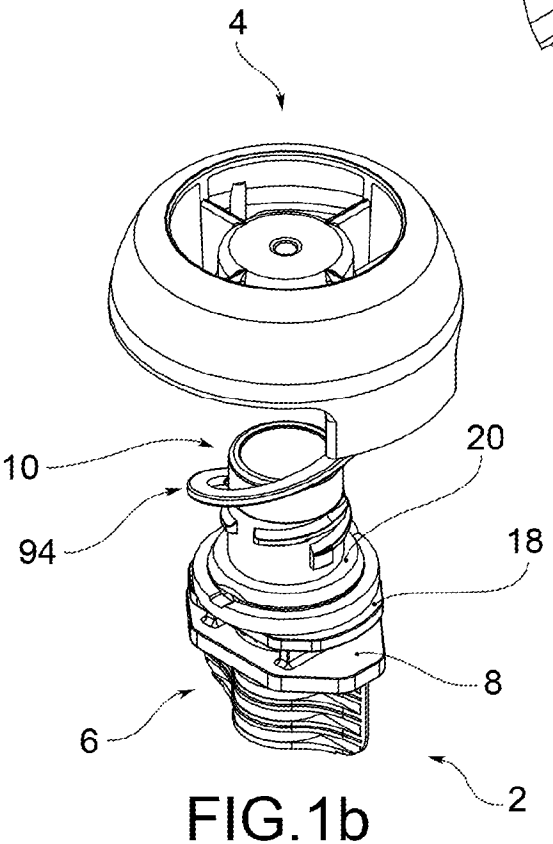
FIG. 1*b* shows a closure assembly in an open configuration.
Figure 1A:
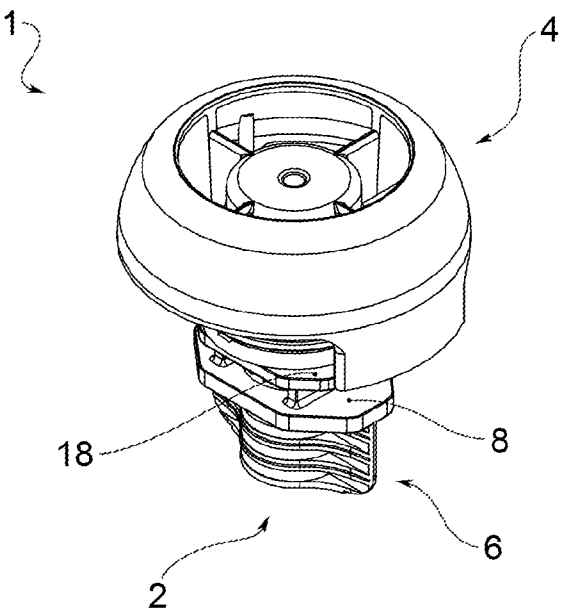
FIG. 1*a* shows a closure assembly, comprising a spout assembly and a closure, in a closed configuration, according to one embodiment of this invention.
Figure 2B:
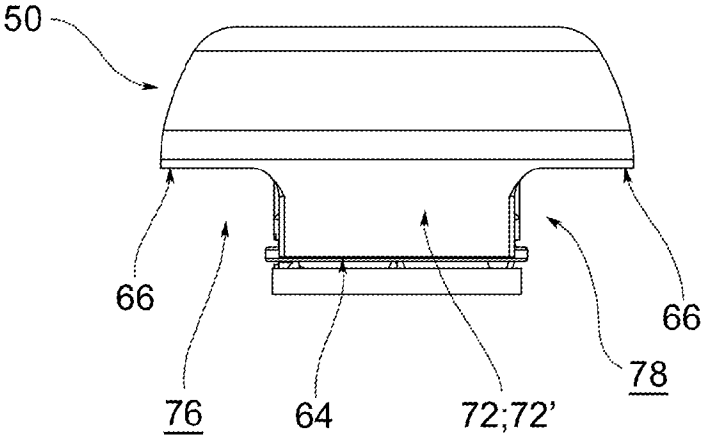
FIG. 2*b* is a side view of the closure, from a different viewing direction.
Figure 2A:
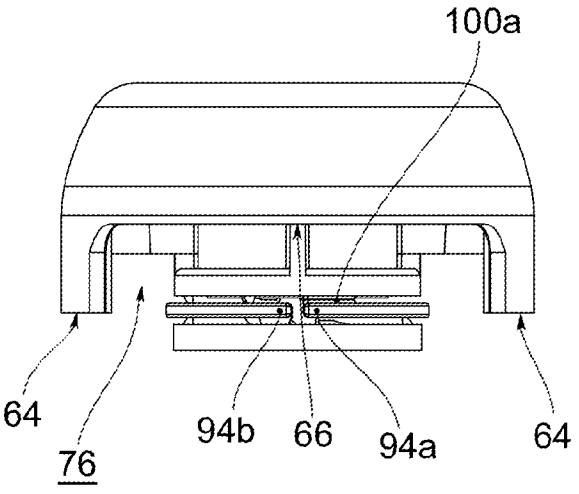
FIG. 2*a* is a side view of a closure, according to one embodiment of this invention, from a first viewing direction.
Figure 2C:
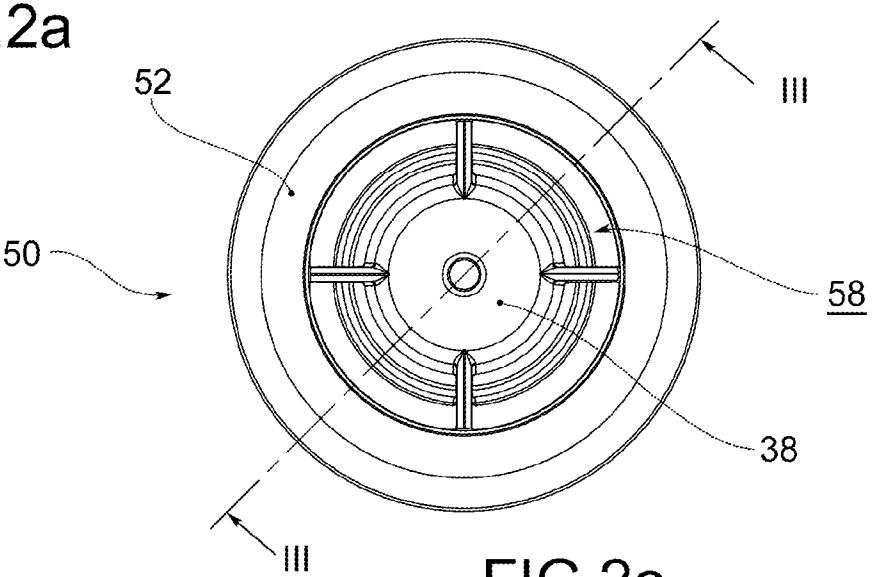
FIG. 2*c* is a plan view from the top of the closure.
Figure 3:
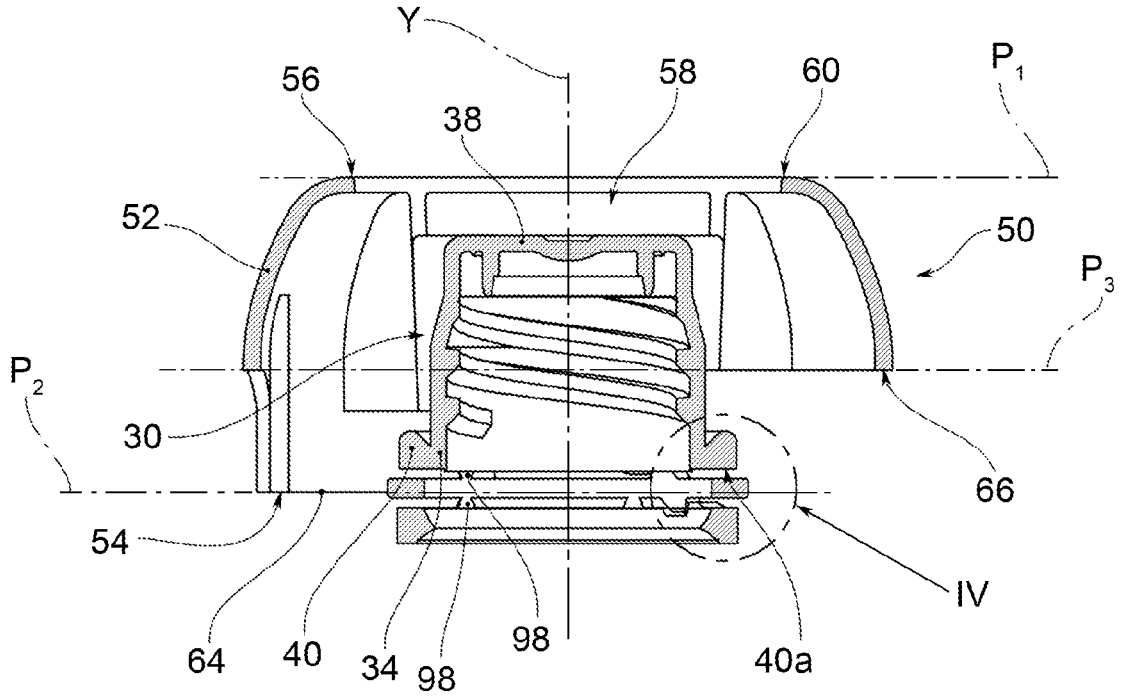
FIG. 3 is a view of the closure in cross-section, according to the section plan III-III of FIG. 2*c;*
Figure 4:
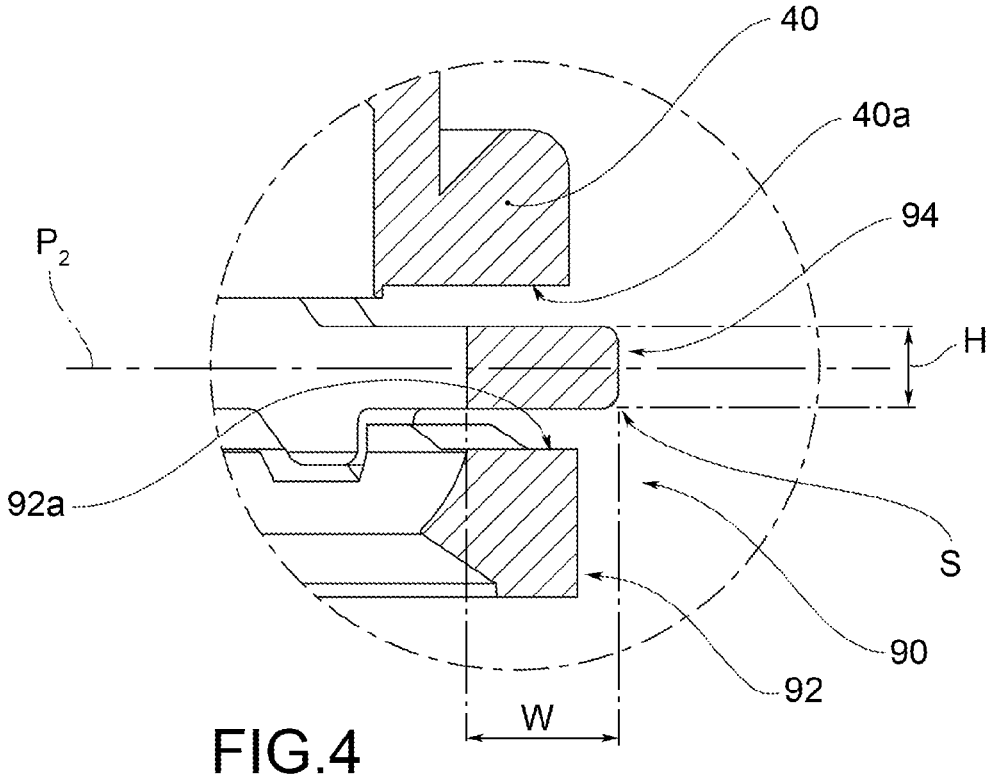
FIG. 4 is an enlargement of Box IV of FIG. 3, highlighting a tamper-evident seal.
Figures 5, 6, 7, 8:
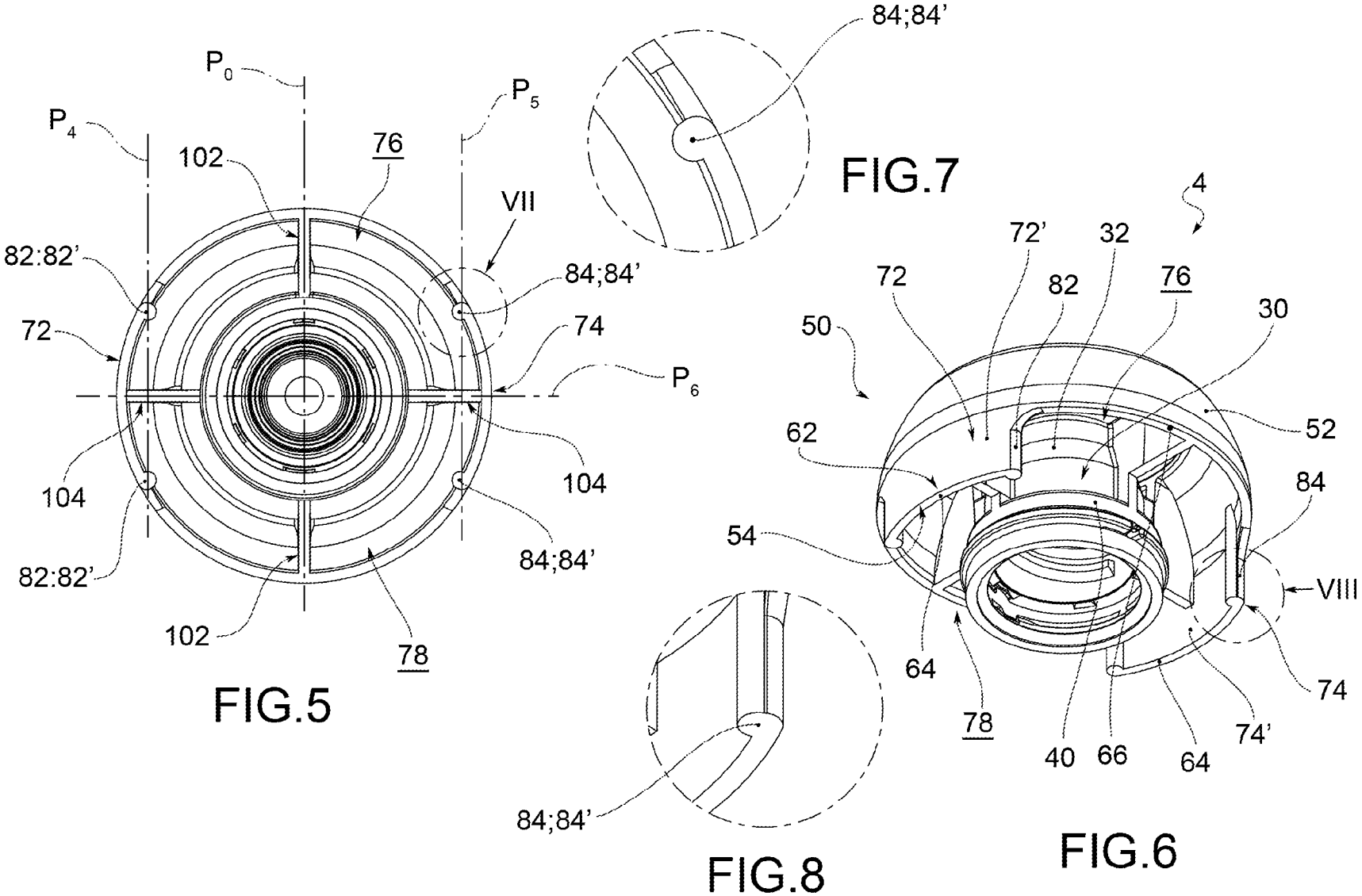
FIG. 5 is a plan view from the bottom of the closure.
FIG. 6 shows the closure according to an embodiment of this invention.
FIG. 7 is an enlargement of the box VII of FIG. 5, showing the configuration of a limit section of a bulge of the grip surface.
FIG. 8 is an enlargement of the box VIII of FIG. 6, showing the configuration of a limit section of a bulge of the grip surface.
Figure 9B:
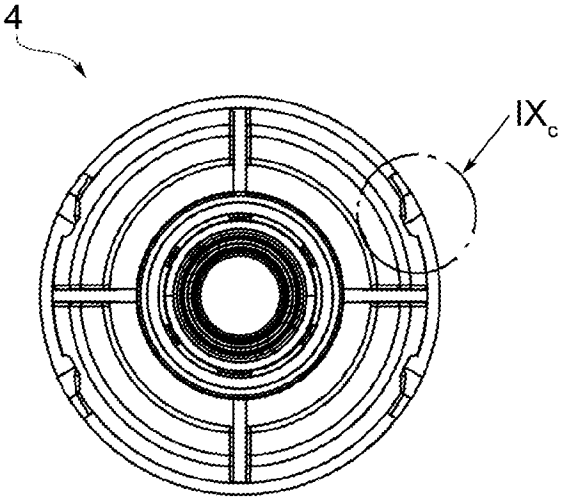
FIG. 9*a* through 9*d* show a closure according to a further embodiment of this invention.
Figure 9C:
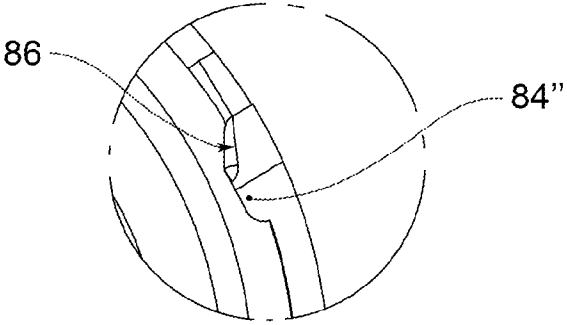
Figure 9A:
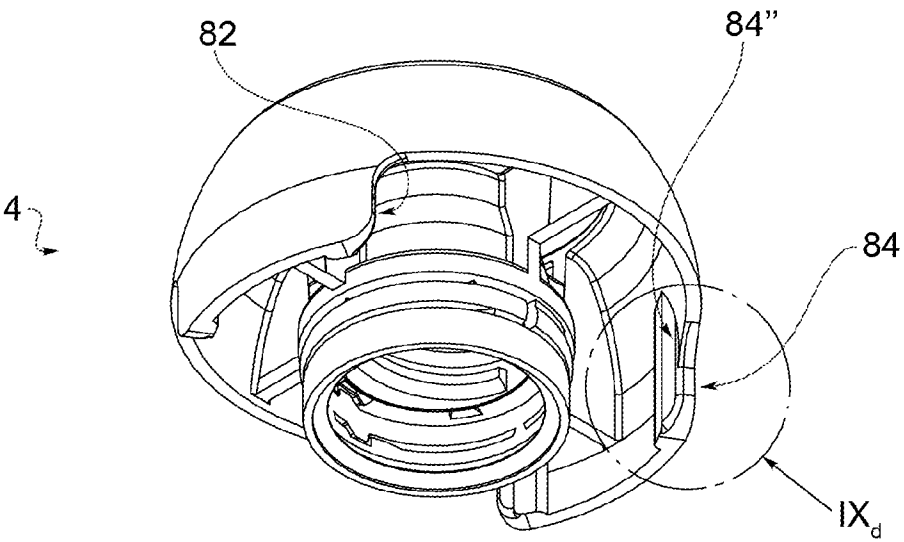
Figure 9D:
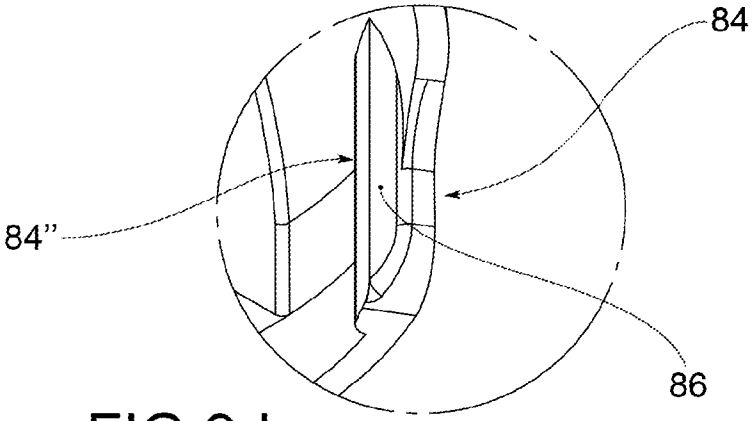
Figure 10B:
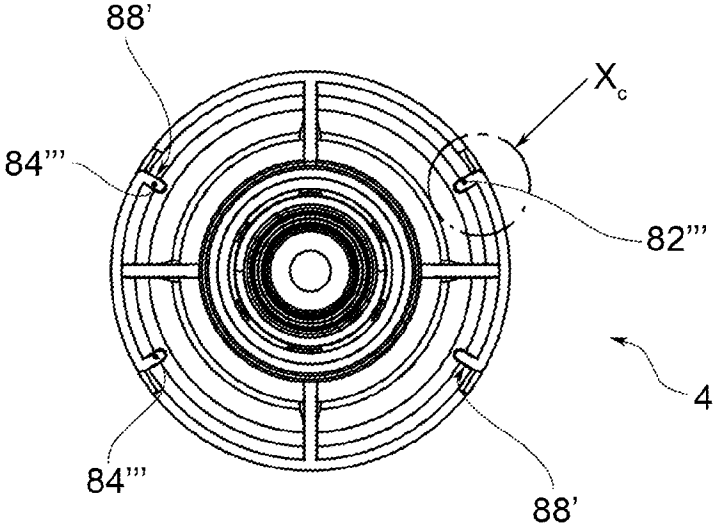
FIG. 10*a* through 10*d* show a closure according to yet another embodiment of this invention.
Figure 10C:
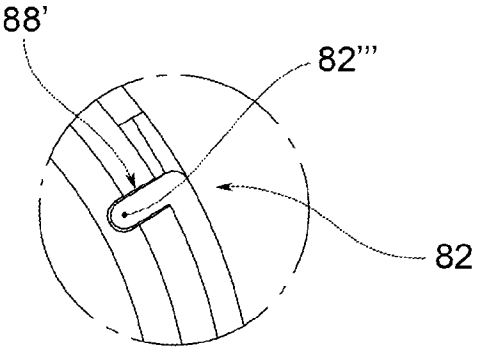
Figure 10A:
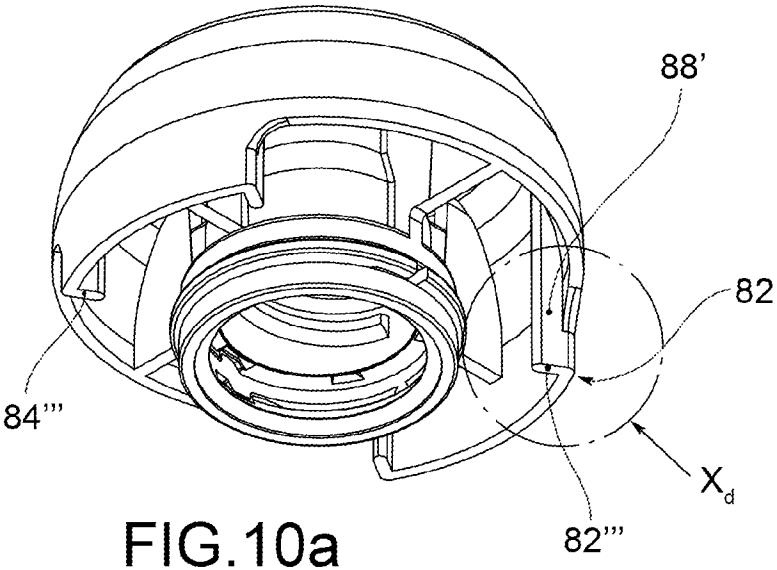
Figure 10D:
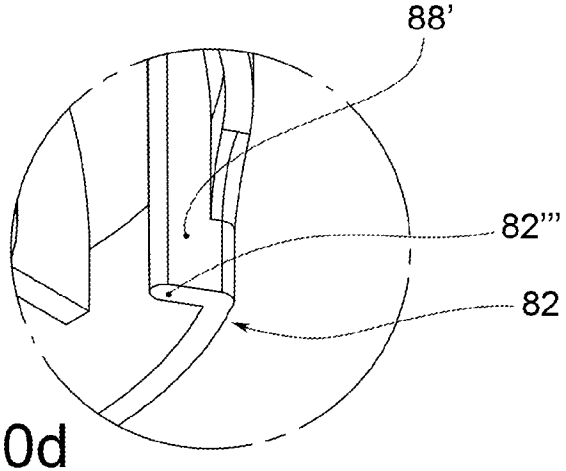
Figure 11B:
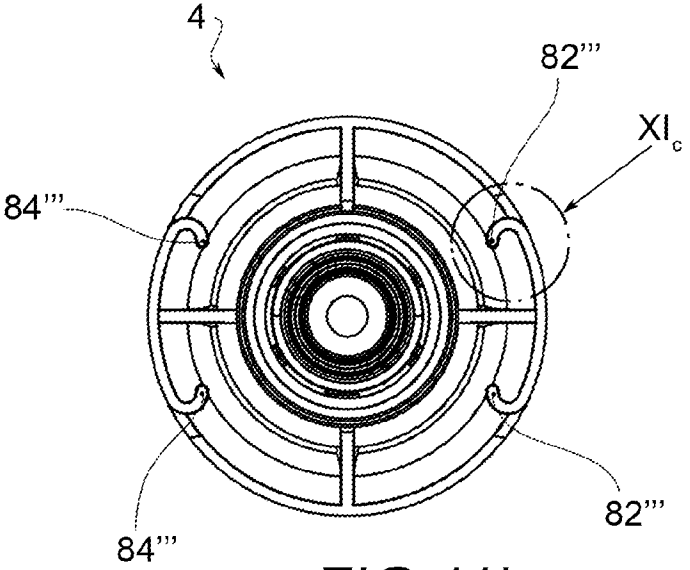
FIG. 11*a* through 11*d* show a closure according to another embodiment of this invention.
Figure 11C:
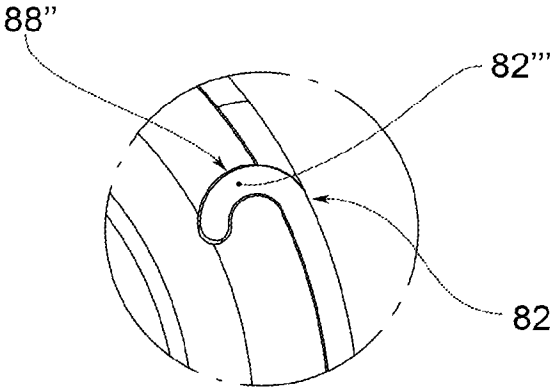
Figure 11A:
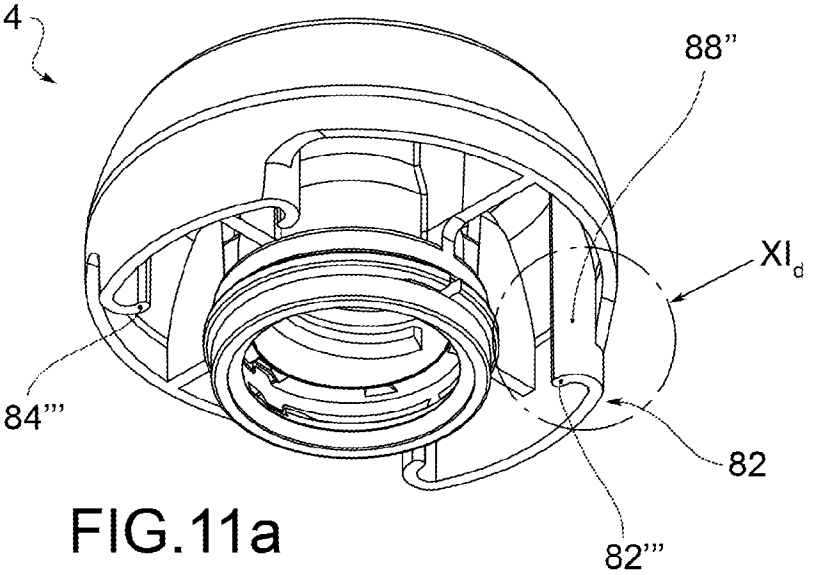
Figure 11D:
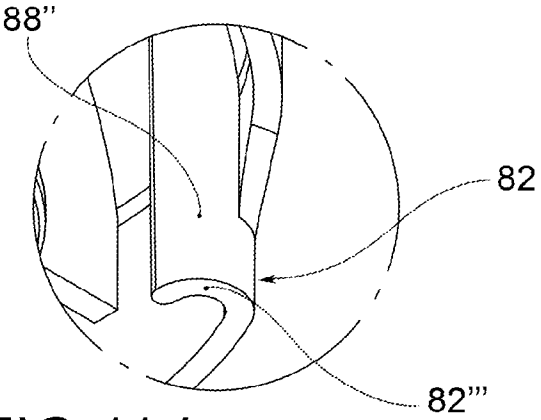

With reference to the figures in the attached tables, 1 has been used to indicate a closure assembly for a thin-walled flexible packaging; the closure assembly 1 comprises a spout assembly 2 and a closure 4 screwable onto the spout assembly 2.

The spout assembly 2 comprises a joining portion 6, generally referred to as a "weld boat," suitable for being sealingly applied to a flexible pouch of the package, delimited on the top by a main plate 8.

The spout assembly 2 further comprises a spout 10 protruding from the main plate 8 at one end and terminating in a through opening 12 of a spout conduit at the other end. The spout 10 comprises a cylindrical spout wall 14 having a central spout axis X and an outer thread 16 protruding from the spout wall 14.

The spout assembly 2 further comprises a secondary plate 18 protruding from the spout wall 14, axially spaced and parallel to the main plate 8, and a constraint ring 20 protruding from the spout wall 14, parallel to the secondary plate 18 and placed opposite the main plate 8 with respect to the secondary plate 18. Therefore, between the secondary plate 18 and the constraint ring 20, a ring seat is formed, which will be discussed hereinafter.

The closure 4 comprises a cap 30 comprising an annular cap wall 32, for example a circular cylindrical or frusto-conical wall, extending about a central cap axis Y, between a cap lower end 34 and a cap upper end 36, internally threaded to screw onto the thread 16 of the spout 10.

For the cap wall 32 a main plane of symmetry P0 passing through the cap axis Y is defined, which will be described hereinafter.

The cap 30 further comprises a cap bottom 38 that closes the cap wall 32 at the cap upper end 36.

Preferably, moreover, the cap 30 comprises an annular cap flange 40 which is continuous or continuous in sections, projecting from the cap wall 32 at the cap lower end 34 and arranged radially externally to said cap wall 32.

Said cap flange 40 has a flat lower face 40*a*, in the form of a circular crown, lying in an imaginary plane orthogonal to the cap axis Y.

The closure 4 further comprises an annular grip surface 50 for gripping the closure.

The grip surface 50 comprises an annular grip wall 52, which is continuous, or continuous in sections, coaxial to the cap axis Y, which surrounds the cap wall 32 and is arranged radially spaced relative thereto.

The grip surface wall 52 extends axially from a lower end 54 to an upper end 56, such that the cap 2 is contained within the grip surface 50.

At the upper end 56, there is a grip surface opening 58, peripherally delimited by an opening edge 60, generally circular, preferably lying on an imaginary plane P1 orthogonal to the cap axis Y. Said imaginary plane P1 is axially arranged so as to be above the cap bottom 38 or coplanar to the outer surface thereof.

At the lower end 54, the grip surface wall 52 has an undulated, for example, continuous, grip surface edge 62 made up of a succession of low sections 64 and high sections 66 that are joined to each other.

The low section 64 is tangent inferiorly to an imaginary plane P2 orthogonal to the cap Y axis, which determines its maximum extension inferiorly. Preferably, the low section 64 is flat, so it lies entirely on the imaginary plane P2.

Said imaginary plane P2 is arranged axially below the lower end of the cap 34 of the cap wall 32, i.e., axially spaced apart from said cap lower end 34, on opposite sides of the cap bottom 38 with respect to the cap lower end 34.

The high section 66 is tangent on the upper side to an imaginary plane P3 orthogonal to the cap axis Y, which determines the maximum extension on the upper side. Preferably, the high section 66 is flat, so it lies entirely on the imaginary plane P3.

Said imaginary plane P3 is arranged axially above the cap lower end 34 of the cap wall 32, i.e., axially spaced from said cap lower end 34, between said cap lower end 34 and the cap bottom 38.

Thus, the course of the grip surface edge 62 is such as to make bulges 72, 74 of the grip surface 50, made up of portions 72', 74' of the grip wall 52 extending between the high section 66 and the low section 64, thereby extending the grasping surface of said grip surface 50.

At the same time, the course of the grip surface edge 62 forms windows 76, 78 of the grip surface 50, which are delimited on the upper side by the high section 66 and preferably not delimited inferiorly.

Preferably, the closure 4 envisages two bulges 72, 74 and two symmetrical windows 76, 78.

Each window 76, 78 is circumferentially delimited by a limit section 82 of the grip surface edge 62, belonging to one bulge 72, and by a limit section 84 of the grip surface edge 62, belonging to the other bulge 74.

According to a first embodiment (FIGS. 5 to 8), said limit sections 82, 84 are made up of rounded elements 82', 84', joined to the remaining portion of the respective bulges 72, 74 and preferably enlarged with respect to the thickness of the remaining portion of the respective bulges 72, 74.

According to a further embodiment (FIGS. 9*a* to 9*d*), at said limit sections 82, 84, internally to the grip surface wall 52, axial ribs 82", 84" are envisaged, preferably provided with a joining plane 86 with the edge of the limit section 82, 84.

According to a still further embodiment (FIG. 10*a* to 10*d*), the limit sections 82, 84 comprise a respective inwardly projecting recess wall 82'", 84'", provided with a flat support surface 88' lying in a radial plane or parallel to a radial plane, joined to the outer surface of the grip surface wall 52.

According to a further embodiment (FIG. 11*a* to 11*d*), the limit sections 82, 84 comprise a respective inwardly protruding recess wall 82'", 84'" provided with an arched, e.g., circular, support surface 88" joined to the outer surface of the grip surface wall 52. For example, said recess wall 82'", 84'" has a U-shape, protruding inside the grip surface.

According to one aspect of the invention, given a first window 76, delimited in width by the limit sections 82, 84, a first window plane P4, tangent to the first limit section 82 and parallel to the main plane of symmetry P0, and a second window plane P5, tangent to the second limit section 84 and parallel to the main plane of symmetry P0, are defined.

The cap 30 is contained in the direction of the width between said window planes P4, P5.

Furthermore, the second window 78 is circumferentially broader, i.e., wider, than the first window 76, in the sense that it also extends outside the two window planes P4, P5 or, at most, has respective limit sections 82, 84 tangent to said window planes P4, P5.

The closure 4 further comprises a tamper-evident seal 90 suitable for indicating the first opening of the closure.

The tamper-evident seal 90 comprises a tamper-evident ring 92, coaxial to the cap 30, suitable for being applied to the spout assembly 2, and in particular to the spout 10, so as to be axially constrained thereto, and preferably freely rotatable. The tamper-evident ring 92 has an upper face 92*a*, lying in an imaginary plane orthogonal to the cap axis Y, facing the cap 30.

The tamper-evident seal 90 further comprises an annular tamper-evident band 94, placed between the cap 30 and the tamper-evident ring 92, and in particular between the lower face 40*a* of the cap flange 40 and the upper face 92*a* of the tamper-evident ring 92.

The tamper-evident seal 90 further comprises a plurality of breakable bridges 98, which, when intact, join the tamper-evident band 94 to the cap 30 and the tamper-evident band to the tamper-evident ring 92; in particular, preferably, the bridges 98 join the tamper-evident band 94 to the lower face 40*a* of the cap flange and the tamper-evident band 94 to the upper face 92*a* of the tamper-evident ring 92.

The tamper-evident band 94, when the tamper-evident seal is intact, is wrapped about the cap axis Y, overlaps the tamper-evident ring 92, and extends circumferentially between a first end 94*a* and a second end 94*b*, preferably facing each other.

Further, at the first end 94*a*, the tamper-evident band 94 has a first attachment 100*a*, which permanently joins the first end 94*a* to the cap 30, and in particular to the cap flange 40, and, at the second end 94*b*, the tamper-evident band 94 has a second attachment 100*b*, which permanently joins the second end 94*b* to the cap 30.

In other words, said connections 100*a*, 100*b* remain intact and ensure the connection of the tamper-evident band 94 to the tamper-evident ring 92 and to the cap 30 even when the bridges are broken. The tamper-evident band 94 thus forms a tie that keeps the grip surface fastened to the tamper-evident ring, and thus to the spout assembly.

In this regard, FIG. 1*c* illustrates a broken configuration, in which the grip surface is torn from the tamper-evident ring, breaking the tamper-evident band 94 that acts as a tie; in this circumstance, the breakage occurs, preferably, at the attachment to the tamper-evident ring, so that no residual sections are left near the spout.

Preferably, on an imaginary plane passing through the cap axis Y, the tamper-evident band 94 has a lowered cross section S, i.e., having a width W greater than the height H; for example, said cross section is rectangular, having a width greater than the height. Advantageously, this allows the overall height of the closure to be reduced.

Preferably, moreover, the cross section S is configured to protrude radially with respect to the cap flange 40 and/or the tamper-evident ring 92.

Preferably, the tamper-evident band 94 is located at a height such that it is intersected by the imaginary plane P2 tangent to the low section 64 that delimits the grip surface edge 62 inferiorly.

In addition, the tamper-evident seal 90, as well as the cap 30, is contained in the direction of the width between said window planes P4, P5.

The closure 4 further comprises angularly spaced fins 102, 104 that join the grip surface 50 to the cap 30, and in particular the grip surface wall 52 to the cap wall 32.

In particular, each fin 102, 104 is made up of a flat radial element, i.e., substantially lying on an imaginary plane passing through the cap axis Y.

For example, two first fins 102 are provided, lying substantially on the main plane of symmetry P0, and two second fins 104, lying on a secondary plane of symmetry P6, orthogonal to the main plane of symmetry P0 and passing through the cap axis Y.

Preferably, the second fins 104, which are located at the two bulges 72, 74, extend axially to the cap lower end 34 of the cap 30; preferably, however, the first fins 102, which are located at the two windows 76, 78, extend axially to the imaginary plane P3 tangent to the high section 66 of the window 76, 78.

According to a variant embodiment, the tamper-evident seal has a tamper-evident band that forms multiple coiled and overlapping loops.

According to a further variant embodiment, the lower section of the grip surface edge is formed by an arched line or in arched and straight sections, i.e., a broken or split line.

Innovatively, due to the shape of the above-described windows, the closure according to this invention is provided with a tamper-evident seal with annular band forming the tie, and is obtainable by injection molding, preferably in one piece.

The windows, in fact, allow the entry inside the grip surface, orthogonally to the cap axis, of plugs of a molding group, necessary for molding the tamper evident seal.

Also, advantageously, the closure may be easily gripped, due to the bulges that provide a large gripping surface for the fingers.

In a further advantageous aspect, the grip surface may be easily gripped as the bulges are delimited by limit sections that are rounded or beveled or otherwise devoid of edges for the comfortable support of, for example, the fingertips.

It is clear that a person skilled in the art, in order to satisfy current needs, could make modifications to the closure described above, said modifications all being contained within the scope of protection defined in the following claims.

The invention claimed is:

1. A closure for a spout of a flexible thin-walled packaging, comprising:

a cap comprising an annular cap wall having a central cap axis that extends between a cap lower end and a cap upper end, a main plane of symmetry being defined through the central cap axis for the annular cap wall, wherein the cap is internally threaded to be suitable for screwing onto a thread of the spout;

a tamper-evident seal comprising a tamper-evident ring suitable for being applied to the spout, an annular tamper-evident band placed between the tamper-evident ring and the cap lower end, and a plurality of breakable bridges that join the annular tamper-evident band to the tamper-evident ring and the cap, wherein the annular tamper-evident band extends between a first end permanently joined to the cap and a second end permanently joined to the tamper-evident ring to form a tie between the cap and the tamper-evident ring;

a grip surface for gripping the closure, comprising an annular grip surface wall coaxial to the central cap axis, surrounding the annular cap wall and radially arranged spaced apart therefrom, the annular grip surface wall axially extending from a lower end to an upper end, wherein the annular grip surface wall has, at the lower end, an undulated grip surface edge made up of a succession of low sections and high sections that are joined to each other to create bulges and windows of the grip surface, in circumferential sequence;

wherein a first window of said windows is circumferentially delimited by a first limit section of the undulated grip surface edge belonging to a first bulge of said bulges, and by a second limit section of the undulated grip surface edge belonging to another bulge of said bulges;

wherein a first window plane tangent to the first limit section and parallel to the main plane of symmetry and a second window plane tangent to the second limit section and parallel to the main plane of symmetry are defined for said first window;

wherein the cap and the tamper-evident seal are contained in width between said first and second window planes;

wherein an imaginary plane orthogonal to the central cap axis is tangent inferiorly to a low section of the undulated grip surface edge that axially delimits inferiorly at least one of said bulges; and wherein said imaginary plane is arranged axially below the cap lower end of the cap wall.

2. The closure of claim 1, wherein a second window of said windows is circumferentially as wide as the first window or wider than the first window.

3. The closure of claim 1, comprising angularly spaced fins that join the grip surface to the cap, and the annular grip surface wall to the annular cap wall.

4. The closure of claim 3, comprising at least a first fin of said fins at one window of said windows, lying substantially on the main plane of symmetry, which axially extends up to an imaginary plane orthogonal to the central cap axis and tangent to a high section of the undulated grip surface edge, which axially delimits said window at the top.

5. The closure of claim 3, comprising at least a second fin of said fins at one of said bulges, which axially extends up to the cap lower end.

6. The closure of claim 1, wherein the annular tamper-evident band has, on an imaginary plane passing through the central cap axis, a cross section having a width greater than a height.

7. The closure of claim 6, wherein the cross section is rectangular.

8. The closure of claim 6, wherein the cross section is configured to protrude radially with respect to the cap and/or the tamper-evident ring.

9. The closure of claim 1, wherein the annular tamper-evident band is placed at a suitable height to be intersected by the imaginary plane.

10. The closure of claim 1, wherein the closure is made in one piece of plastic material.

11. The closure of claim 10, wherein the closure is made by injection molding.

12. The closure of claim 1, wherein said first and second limit sections consist of rounded elements joined to a remaining portion of respective bulges and enlarged with respect to a thickness of the remaining portion of the respective bulges.

13. The closure of claim 1, wherein axial ribs are provided at said first and second limit sections, within the annular grip surface wall.

14. The closure of claim 13, wherein each of the axial ribs is provided with a joining plane for joining with a corner of a respective limit section.

15. The closure of claim 1, wherein each limit section comprises a respective inward-protruding recess wall provided with a flat or curved supporting surface joined to an outer surface of the annular grip surface wall.

16. A closure for a spout of a flexible thin-walled packaging, comprising:

a cap comprising an annular cap wall having a central cap axis that extends between a cap lower end and a cap upper end, a main plane of symmetry being defined for the annular cap wall, wherein the cap is internally threaded to be suitable for screwing onto a thread of the spout;

a tamper-evident seal comprising a tamper-evident ring suitable for being applied to the spout, an annular tamper-evident band placed between the tamper-evident ring and the cap lower end, and a plurality of breakable bridges that join the annular tamper-evident band to the tamper-evident ring and the cap, wherein the annular tamper-evident band extends between a first end permanently joined to the cap and a second end permanently joined to the tamper-evident ring to form a tie between the cap and the tamper-evident ring;

a grip surface for gripping the closure, comprising an annular grip surface wall coaxial to the central cap axis, surrounding the annular cap wall and radially arranged spaced apart therefrom, the annular grip surface wall axially extending from a lower end to an upper end, wherein the annular grip surface wall has, at the lower end, an undulated grip surface edge made up of a succession of low sections and high sections that are joined to each other, the undulated grip surface edge creating bulges and windows of the grip surface, in circumferential sequence;

wherein a first window of said windows is circumferentially delimited by a limit section of the undulated grip surface edge belonging to a first bulge of said bulges, and by a limit section of the undulated grip surface edge belonging to another bulge of said bulges;

wherein said limit sections consist of rounded elements joined to a remaining portion of respective bulges and enlarged with respect to a thickness of the remaining portion of the respective bulges.

* * * * *